US007430843B2

(12) United States Patent
Wild et al.

(10) Patent No.: US 7,430,843 B2
(45) Date of Patent: Oct. 7, 2008

(54) DEVICE AND METHOD FOR FILLING FOIL BAGS WITH FOOD

(75) Inventors: Hans-Peter Wild, Eppelheim (DE); Eberhard Kraft, Neckarbischofsheim (DE)

(73) Assignee: Indag Gesellschaft fuer Industriebedarf mbH & Co. Betriebs KG, Eppelheim (DE)

( * ) Notice: Subject to any disclaimer, the term of this patent is extended or adjusted under 35 U.S.C. 154(b) by 0 days.

(21) Appl. No.: 11/367,858

(22) Filed: Mar. 3, 2006

(65) Prior Publication Data

US 2006/0196152 A1 Sep. 7, 2006

(30) Foreign Application Priority Data

Mar. 4, 2005 (EP) ..... 05004822

(51) Int. Cl.
*B65B 1/04* (2006.01)

(52) U.S. Cl. ..... 53/469; 53/467; 53/473

(58) Field of Classification Search ..... 53/467–469, 53/473, 474, 476, 477, 479, 249
See application file for complete search history.

(56) References Cited

U.S. PATENT DOCUMENTS 3,340,679 A * 9/1967 Johnson ..... 53/385.1
3,813,847 A 6/1974 Kuhnle
4,074,507 A 2/1978 Ruf et al.
4,216,639 A * 8/1980 Gautier ..... 53/413
4,631,905 A * 12/1986 Maloney ..... 53/554
5,058,634 A 10/1991 Tisma et al.
5,309,825 A * 5/1994 Pinone ..... 99/323.6
5,337,539 A * 8/1994 Barton ..... 53/413
5,408,804 A * 4/1995 Schroder ..... 53/452
5,417,039 A * 5/1995 Hansson et al. ..... 53/449
5,419,238 A * 5/1995 Pinone ..... 99/323.6
5,771,665 A 6/1998 Nelson et al.
5,845,463 A * 12/1998 Henaux ..... 53/450
5,845,464 A 12/1998 Draghetti (Continued)

FOREIGN PATENT DOCUMENTS

DE 28 19 689 A1 11/1979

(Continued)

OTHER PUBLICATIONS

Non-Final Second Office Action (Non-Final Rejection), dated Oct. 11, 2007, in Korean Patent Appln No. 2006-20706, which is the counterpart to the subject application.

(Continued)

*Primary Examiner*—Hemant M Desai
(74) *Attorney, Agent, or Firm*—Stroock & Stroock & Lavan LLP

(57) ABSTRACT

The invention relates to a device (1) for the filling of foil bags (24) with foods (42), a transport device (23) for transporting the foil bags (24), a filling device (27) for the dosed filling of the foil bags (24) with solid foods (42) and a closing device (43) for closing the foil bags (24). Furthermore, the invention relates to a method of filling foil bags (24) with foods (42) comprising the following steps: transport of the foil bags (24), dosed filling of the foil bags (24) with solid foods (42) and closing the foil bags (24).

73 Claims, 5 Drawing Sheets

U.S. PATENT DOCUMENTS

| | | | | |
|---|---|---|---|---|
| 6,311,745 | B1 * | 11/2001 | Welch et al. | 141/346 |
| 2001/0010142 | A1 | 8/2001 | Todd et al. | |

FOREIGN PATENT DOCUMENTS

| | | | |
|---|---|---|---|
| DE | 43 36 233 | A1 | 4/1995 |
| DE | 202 20 644 | U1 | 12/2003 |
| EP | 0 043 875 | | 1/1982 |
| JP | 59 062421 | A | 4/1984 |
| JP | 2005-289379 | * | 10/2005 |
| KR | 2001-85029 | | 9/2001 |
| WO | WO 03/000553 | A | 1/2003 |
| WO | WO 2005/012101 | A | 2/2005 |

OTHER PUBLICATIONS

Chinese First Notification of Office Action, dated Sep. 28, 2007, in Chinese Patent Appln No. 200610058612.1, which is the counterpart to the subject application.

* cited by examiner

DEVICE AND METHOD FOR FILLING FOIL BAGS WITH FOOD

BACKGROUND OF THE INVENTION

The invention relates to a device and a method for filling foil bags with food. Here, food can be food for both human consumption and for animals, such as pets or similar.

Devices for filling foil bags with drinks, i.e. liquid foods, are known. In order to fill a desired quantity, the flow rate is determined during filling and filling is stopped when the specified quantity is reached.

The object of the present invention is to be able to fill foods other than drinks into foil bags.

The term food is intended to cover all consumable substances, i.e. including those which are not nutritious but which nonetheless may occur in comestibles.

The solid foods are preferably present as granulates, grains, in globular shape, as pellets, sticks or similar.

SUMMARY OF THE INVENTION

The device according to the invention has a dosing device with which a predetermined quantity of solid food can be measured. The quantity measured out in such a way can then be transferred quickly into the bag with a filling device for filling the foil bags with solid foods. In the method, the solid foods are first measured out and then filled into the foil bags. Because of the fact that a quantity is first measured out which is then filled, it is possible to fill solid foods in dosed form and to do so quickly.

In addition to filling with solid foods, filling with liquid foods may also be provided. A mixture can then form in the bag.

It is advantageous to have a dosing device with which various quantities can be dosed, i.e. to be able to fill different quantities. This means that, depending on the desired composition of the bag content, which may be made up of different components, a different quantity of solid foods can be filled.

Advantageously, the device has a dosing chamber the size of which can be adjusted. In this way, different quantities can be set. In this respect, the dosing chamber is advantageously adjustable in a telescope form. This allows the simplest possible construction of a size-adjustable dosing chamber.

The dosing chamber is advantageously formed in, at, on top of, below or near a slide, so that the dosing chamber can be moved with the slide, whereby the slide is moved by a drive. The slide can be separated from the drive, in response to a control command, so that if there is no foil bag, the slide and thus the dosing chamber are not moved in order to prevent any discharge of solid food, since this cannot be picked up by a foil bag.

A storage hopper for the solid food is advantageous. This can have a distribution unit which distributes the solid food evenly in the storage hopper. This ensures that several foil bags are filled evenly at the same time.

It is advantageous to provide a product line which ends at the filling position of the foil bags. This ensures the safe supply of the solid foods to the foil bags. Advantageously, this product line is in the form of a hopper so that the feeding of foods into the product line is as simple as possible.

The product line is preferably movable, so that the end of the product line can be moved into and out of the foil bags. To fill the foil bags, it is advantageous if the product line ends in the foil bag, whereas it is advantageous for the transport of the foil bags before or after filling if the product line ends outside the foil bag.

Furthermore, it is advantageous if; at the upper end of or above the product line, a fluid outlet is provided with which a fluid can be passed into the product line. In this way, it is possible to create a gas or liquid buffer which prevents solid foods sticking to the product line. The same fluid outlet or another fluid outlet can also be provided, by which, for example, steam is passed into the product line in order to moisten it. This also prevents the solid foods from sticking.

For the transport of the foil bags, simple receptacles are advantageously provided into which the foil bags can be inserted. This guarantees the cheapest possible, mechanically simple acceptance of the foil bags for transport. The receptacles are designed in such a way that suitable foil bags are slightly open in the receptacle.

For wider opening for filling, pressure arms can be provided which press on the foil bags at the side, whereby these preferably have a shape which is adapted to an opened foil bag in order to be able to support the foil bag for the filling process. Pulling arms can also be provided which pull up the foil bag at its filling opening for the filling process.

With the method according to the invention, advantageously a dosing chamber is moved back and forth between a loading and an unloading position, whereby dosing is achieved.

Furthermore, with the method, advantageously the size of the dosing chamber is changed so that different quantities can be filled.

A method is advantageous in which a check is carried out to see whether there is a foil bag to receive the solid food at the filling position or not. If it is found that no foil bag is present, the dosing chamber is not taken to the unloading position, so that no food is wasted and the machine is not soiled.

The product line with which the food is passed into the foil bag is preferably movable. In this way, the product line can be moved several times jerkily to the foil bag and away from it in order to make sure that the solid foods pass through the product line.

BRIEF DESCRIPTION OF THE INVENTION

Advantageous embodiments of the invention are illustrated in the attached figures, in which.

DETAILED DESCRIPTION OF THE PREFERRED EMBODIMENTS OF THE INVENTION

Figure 1:
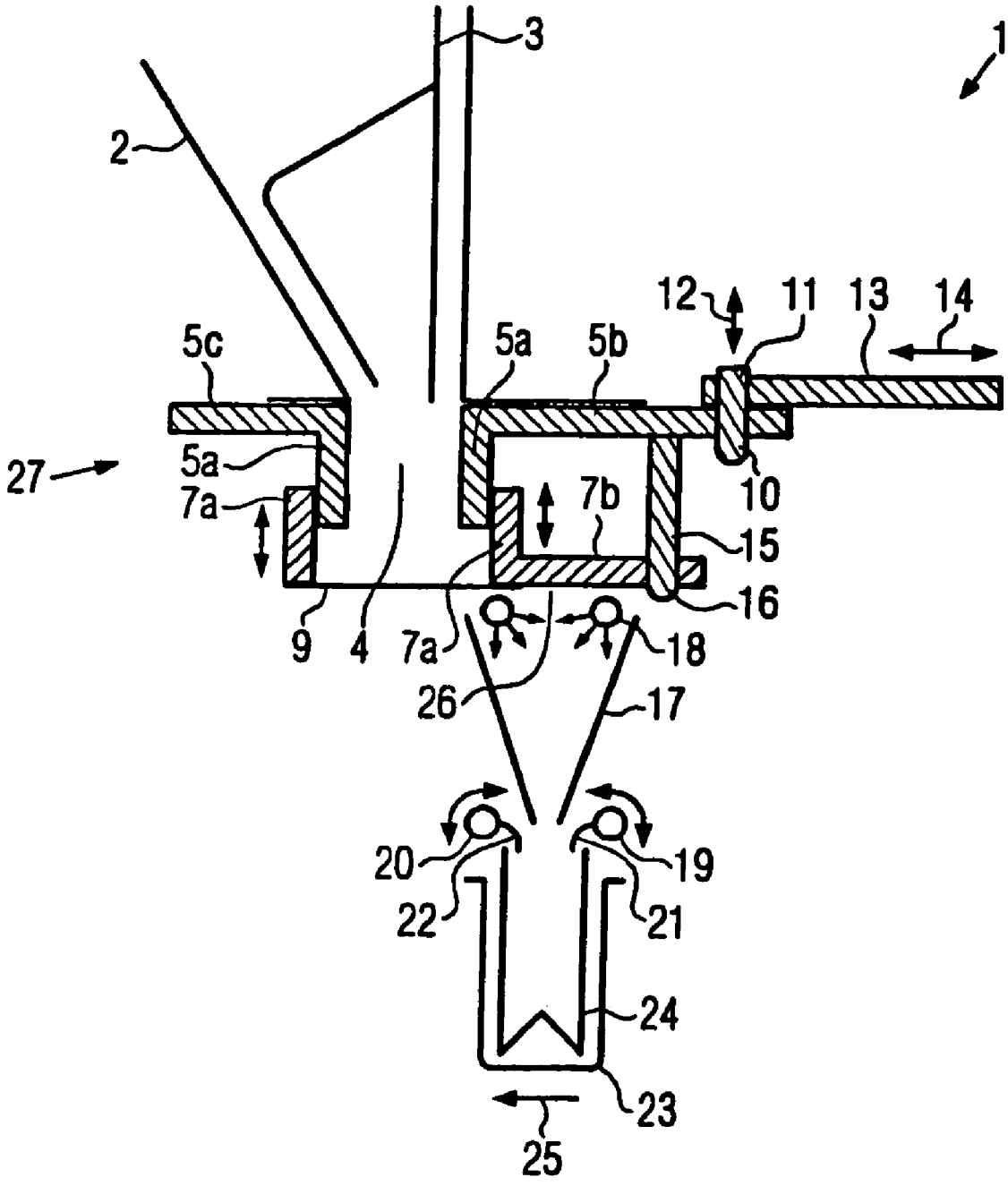
FIG. 1 shows a schematic sectional drawing of a device.

FIG. 1 shows a device 1 for filling foil bags 24. Solid food can be held in a storage hopper 2 in order to be able to carry out a filling process for a long time without topping up. The food can be evenly distributed with a linear stirring unit 3 in the storage hopper 2. The linear stirring unit moves stirring rods or stirring brackets back and forth in the solid food. This allows gentle handling with even distribution in the storage hopper 2.

A dosing chamber 4 is shown underneath the storage hopper 2. This is bordered at the side by two cylindrical elements 5*a* and 7*a*. At the bottom, the dosing chamber 4 is closed off by a plate 9. The dosing chamber 4 is in the loading position here, since it is underneath the storage hopper 2. The cylindrical elements 5*a* and 7*a* are each connected with slide parts 5*b* and 7*b*. These two slide parts 5*b* and 7*b* are connected with each other by a peg 15, whereby they can move against each other in the vertical plane in FIG. 1. For this, the peg 15 engages with an opening 16 in the slide part 7*b*. The peg 15 gives a good coupling of the slide parts 5*b* and 7*b*, whereby, however, mobility in the vertical plane is retained, which is important for the adjustment of the size of the dosing chamber (see below).

One of the two slide parts 5*b*, 7*b* (in this case, 5*b*) has an opening 10 with which a movable pawl 11 can engage. The pawl 11 can be moved up and down along the direction 12. The element 13 represents a drive which can be moved back and forth in direction 14. If the pawl 11, as shown in FIG. 1, projects into the opening 10, then the slide part 5*b* is moved together with the slide parts 5*a* and 5*c* when the drive 13 is moved. Furthermore, the slide part 7*b* and thus also the slide part 7*a* are also moved by the peg 15. Using the drive 13, the entire dosing chamber 4 can thus be moved if the pawl 11 projects into the opening 10. If the pawl 11 is pulled out of the opening 10, the entire dosing chamber remains in its position. This is particularly advantageous for a machine in which several dosing chambers 4 are positioned next to each other which can all, however, be moved with one and the same drive 13. If a dosing chamber 4 is not to be moved, because for example no foil bag is present to be filled, then the pawl 11 can be pulled out of the opening 10 for this dosing chamber 4 so that when the drive 13 is moved for the other dosing chambers 4 which are to be moved, the one dosing chamber remains in its position. The pawl 11 is moved in the direction 12 preferably automatically using for example a pneumatic, mechanical or hydraulics system or an electrical motor. The automatic operation is preferably connected with a sensor which determines whether a foil bag is in the filling position or not.

The plate 9 has an opening 26 above the hopper 17. If the dosing chamber 4 is moved to the right above this opening 26, the contents of the dosing chamber 4 can fall downwards into the hopper 17. Above the opening 26 in the plate 9 is the unloading position of dosing chamber 4.

The lower opening of the storage hopper 2 and the opening 26 can also be positioned further away from each other in the horizontal direction in FIG. 1. This can prevent solid food being passed through the opening 26 whilst the dosing chamber 4 is in a middle position between the loading and unloading position and new solid food sliding at the same time from the storage hopper 2 into the emptying dosing chamber 4.

Between the unloading position of the dosing chamber 4 and the filling hopper 17 a ring-shaped line 18 with openings is arranged. These openings can, for example, blow air into the filling hopper 17, in order to prevent the content of the dosing chamber 4, which falls into the filling hopper 17, from sticking to the filling hopper 17 or blocking it. The gas flowing out of the ring line 18 forms a compressed air buffer here.

A foil bag 24 can be arranged in a receptacle 23 at the lower end of the filling hopper 17. Above the foil bag 24, there are two rods 19, 20, which are supported so that they can be swiveled. At the rods 19, 20, arms 21, 22 are positioned which can reach from above into the foil bag 24 and open it wide at its top side through a spreading movement of the arms 21, 22.

Transport of the foil bags 24 by the receptacles 23 is provided in the direction 25.

Figure 2:
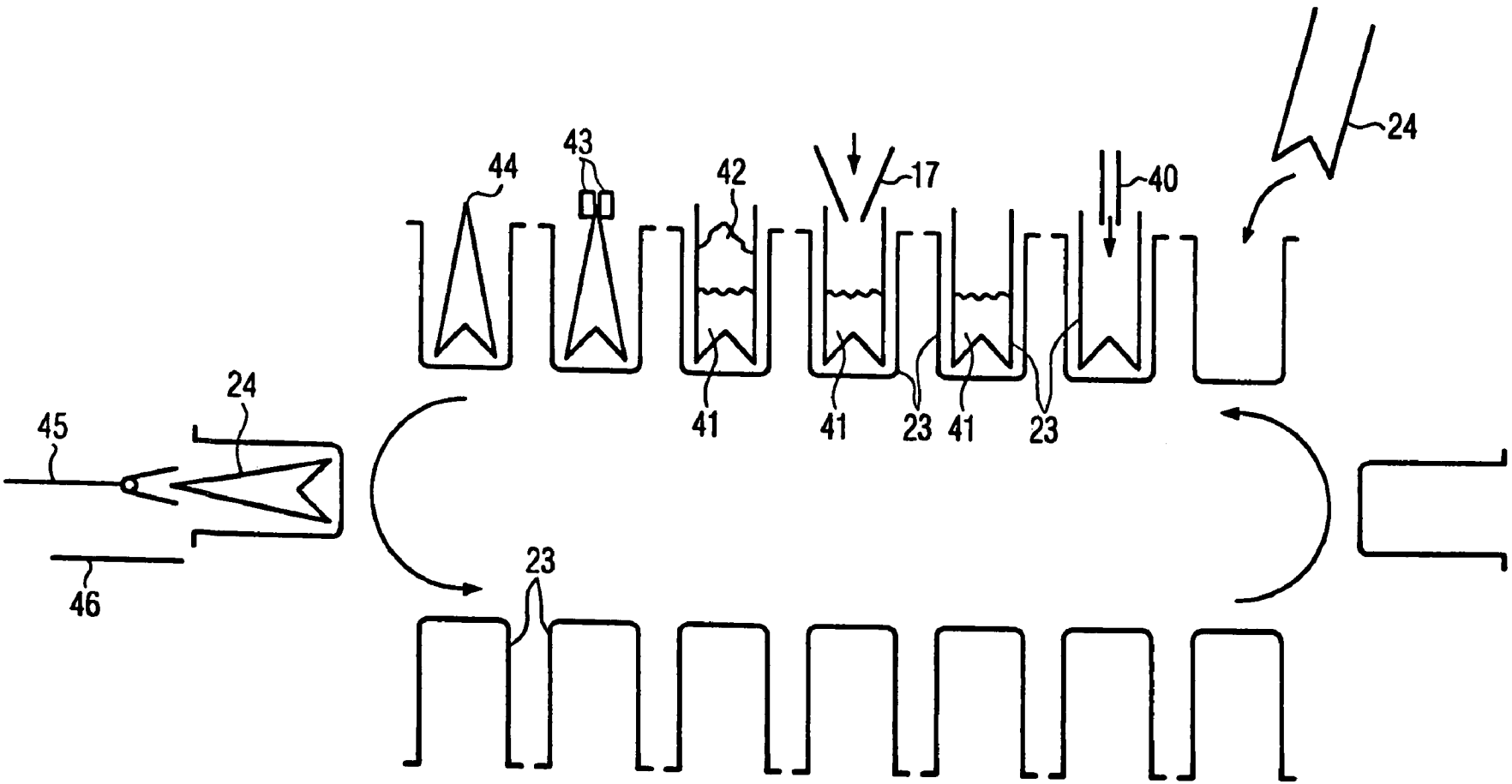
FIG. 2 shows a schematic sectional drawing of a device for filling.

FIG. 2 shows a complete device for the filling of foil bags in schematic form. Various receptacles 23 are provided with foil bags 24. Furthermore, a filling pipe 40 is provided to pass liquids 41 into the foil bags 24. Furthermore, a filling hopper 17 for filling the foil bags 24 with solid foods 42 is shown schematically. The position of the filling pipe 40 and the filling hopper 17 can also be swapped over, i.e. firstly solid and then liquid foods can be filled. In addition, heat-sealing blocks 43 are shown, with which the upper ends of an open foil bag can be heat-sealed with each other so that these are leak-tight. This forms a heat-sealing seam 44. The two heat-sealing blocks 43 can each be swung away upwards in order to take the next bag 24 into the position where the heat-sealing blocks 43, which have then been swung back down, can heat-seal a bag 24.

The receptacles 23 are then turned by 90° at the end of a conveyor so that the foil bags 24 can be removed with a gripper 45. The foil bags 24 which have been removed can be deposited, for example, on a conveyor belt 46 and thus transported away. The empty receptacles 23 can be transported back by the conveyor in order to be provided with a foil bag 24.

FIGS. 1 and 2 aim to explain the method according to the invention. FIG. 2 shows how a foil bag 24 is inserted into receptacles 23, on the far right. The foil bag 24 is held by the receptacle 23 in such a way that it is slightly open. Opening devices which will be discussed in the following open the bag 24 in such a way that a filling pipe 40 can pass liquid into the foil bag 24. The foil bag 24 filled with liquid 41 in this way is transported in FIG. 2 further to the left. As soon as the foil bag 24 has arrived under a filling hopper 17, this is opened again with the corresponding devices, then the filling hopper 17 is lowered into the foil bag 24 and solid food 42 is filled into the foil bag 24. For this, the dosing chamber 4 is loaded in the loading position so that, through the volume of the dosing chamber 4, a defined quantity is measured out and then taken into the unloading position above the filling hopper. From there, the solid food is passed through the filling hopper 17 into the bag 24. After this, the foil bag 24 is heat-sealed with heat-sealing blocks 43 at its upper end, so that it is sealed with a heat-sealing seam 44. After this, the receptacles 23 are turned by 90° so that the foil bags 24 are lying horizontally and can be removed with a gripper 45. The gripper 45 places the filled, sealed foil bags 24 onto a conveyor belt 46, which transports these away.

The device in FIG. 2 works cyclically. Within one cycle, the bags are moved on by one handling position each time. Furthermore, it has a number of parallel filling lines which are each equipped with a filling hopper 17 and a filling pipe 41.

Figure 3A:
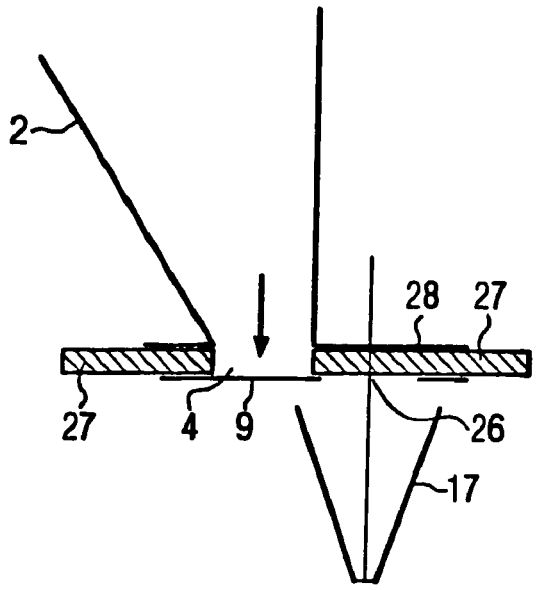
FIG. 3 shows a schematic sectional drawing of a dosing device.
Figure 3B:
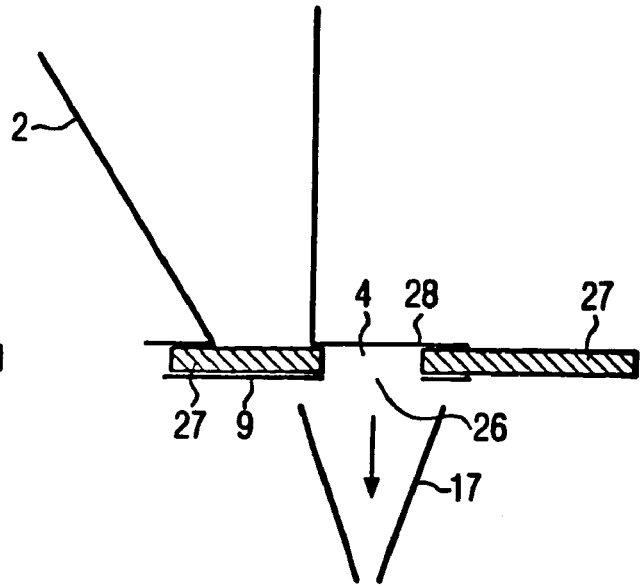

FIG. 3 shows a simplified version of the filling device, to illustrate the filling of the foil bags 24 with solid foods 42. Instead of a dosing chamber 4, the size of which can be adjusted, FIG. 3 shows a dosing chamber 4 with a fixed size. The explanations concerning FIG. 3, however, also apply correspondingly for a dosing chamber 4 as shown in FIG. 1.

FIG. 3*a* shows the dosing chamber 4 which is formed in a single slide 27 underneath a storage hopper 2. The lower end of the dosing chamber 4 is provided with a plate 9. In the position in FIG. 3*a*, solid food can pass from the storage hopper 2 into the dosing chamber 4. Afterwards, the dosing chamber 4 is moved to the right through the movement of the slide 27. In this, part of the slide 27 closes the lower end of the storage hopper 2 so that nothing is discharged in an uncontrolled way from the storage hopper 2. Furthermore, to the right of the storage hopper 2, a cover plate 28 is provided which delimits the dosing chamber 4 upwards. The lower cover plate 9 has an opening 26 which is at the unloading position of the dosing chamber 4. If the dosing chamber 4 is pushed over this opening 26, the solid food can fall from the dosing chamber 4 into the filling hopper 17. The empty dosing chamber 4 can then be moved with the slide 27 back into the position in FIG. 3*a*, where it can be loaded again.

FIG. 4 shows schematically how the size of the dosing chamber 4 can be changed. The cylinder wall 7 and the lower plate 9 can be adjusted in height together.

Figure 4A:
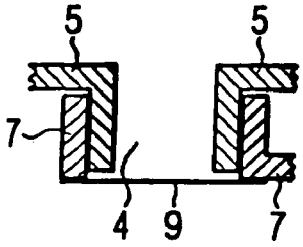
FIG. 4 shows a schematic illustration of a dosing chamber in various sizes.

FIG. 4*a* shows a layout in which the cylinder 7 and the plate 9 are right at the top so that the dosing chamber 4 has a minimal volume.

Figure 4B:
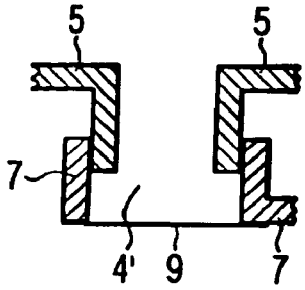
Figure 4C:
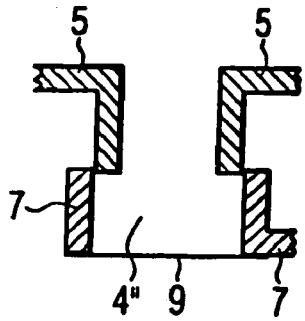

FIG. 4*b* shows a condition in which the dosing chamber 4' is medium-sized, and FIG. 4*c* shows how the dosing chamber 4" has the maximum size.

In FIGS. 1 and 4, the dosing chamber 4 is formed by two cylinder walls 5 and 7. However, more cylinder walls can also be provided which are positioned so that they can be pushed into each other like a telescope in order to obtain a larger adjustment range for the dosing chamber.

FIGS. 1 and 4 show the wall thicknesses of the cylinder walls 5 and 7 as being very thick. The walls 5 and 7 may also be made from thin metal sheets or similar.

The dosing chamber 4 can be adjusted automatically. Suitable means of adjustment can be provided for this, such as pneumatic, mechanical or hydraulic systems or electrical motors.

If several dosing chambers 4 are provided for several filling lines, the size of the chambers can also be adjustable with a common means of adjustment so that all the dosing chambers 4 are changed in the same way. For example, a common plate 9 can be provided, which is adjusted in height so that the cylinder walls 7 are also adjusted. For the adjustment of the plate 9, four adjustment devices can be provided at the corners of the plate 9 which are controlled, for example, by a belt running around the four corners.

FIG. 5 shows foil bags 24 in the receptacles 23. The foil bags 24 have sides 31, 32, which are lightly pressed together by the receptacle 23 so that the side foils 33 and 34 move apart from each other and open up a filling opening 30. In order to open the filling opening 30 to a larger filling opening 30', elements 35, 36 can be taken to the side of the foil bags 24 in order to press the sides 31, 32 even closer together and thus obtain the larger filling opening 30'. The elements 35, 36 have a triangular recess with which they can support the side foils 33, 34 in the opened state. At the tip of the triangular recess in elements 35, 36 are slots 37 to take the side heat-sealed seams at the sides 31, 32 of the foil bag 24. This provides a particularly good stabilization of the bags during filling.

Figure 5A:
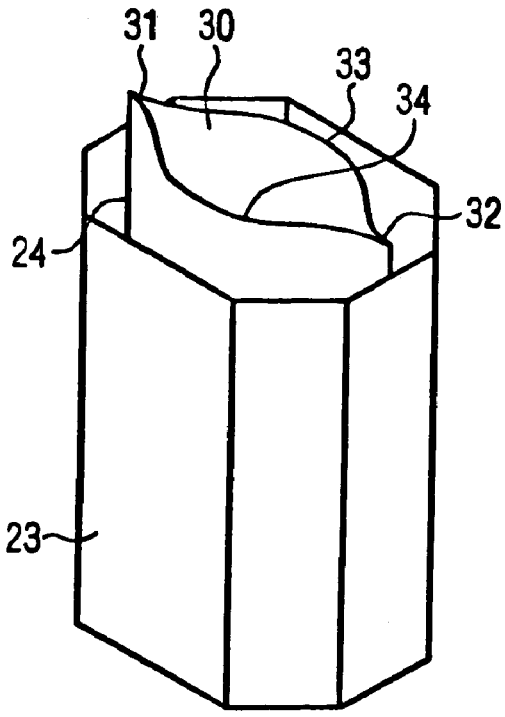
FIG. 5 shows a foil bag in various opening positions.
Figure 5B:
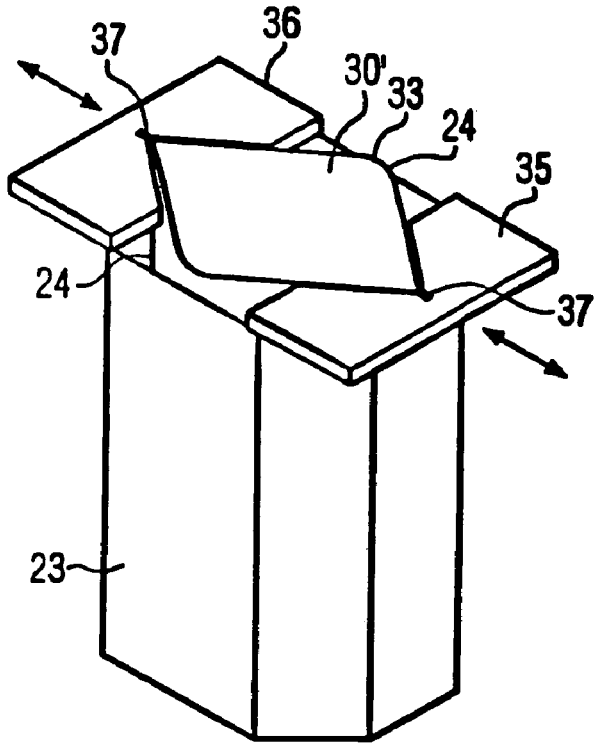

The elements 35, 36 shown in FIGS. 5*a* and 5*b* can be provided both for filling with liquid foods (see filling pipe 40 in FIG. 2) and for filling with solid foods (see filling hopper 17 in FIG. 2).

Figure 6:
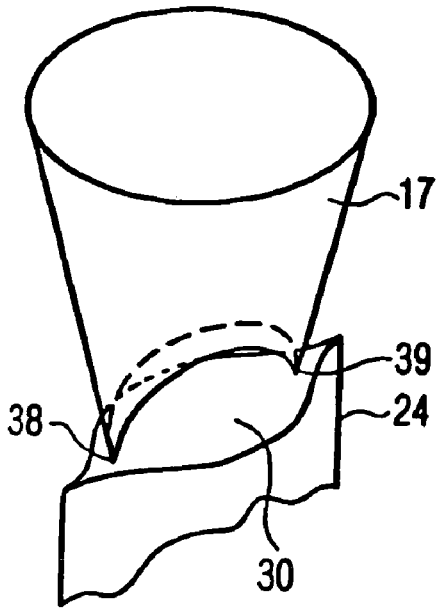
FIG. 6 shows a product line and a foil bag.

FIG. 6 shows the lower end of the filling hopper 17, which has wedge-shaped ends 38, 39. These ends 38, 39 can easily be inserted into a slightly opened foil bag 30 so that, when the filling hopper 17 is lowered, it opens the opening 30 of the foil bag 24 further so that the lower end of the filling hopper 17 can be inserted completely into the foil bag 24.

At the lower end of the filling hopper 17 (see FIG. 6), side gas outlet openings 47 can also be provided which allow the gas flowing from the ring line 18 to be taken out of the filling hopper 17 outside the foil bag 24. The openings should be small enough to ensure that the solid food does not pass through them.

The filling hopper 17 can also be provided with openings 47 through which air or liquid is passed into the inside of the filling hopper 17. These openings 47 can be provided over the full length or only a part of the filling hopper 17. It is advantageous to position these openings 47 particularly where the solid food would hit the wall of the filling hopper, since the incoming air will thus prevent the solid food from sticking to the wall. The air forms an air buffer in this case. These openings 47 are particularly advantageous at the lower end of the filling hopper 17, since here the danger of the filling hopper 17 becoming blocked is particularly high, since the filling hopper 17 is narrowest here. Water or a cleaning liquid can also be passed into the filling hopper through the openings 47 for cleaning purposes. Corresponding feed lines must be provided for the air or cleaning fluid on the outside of the filling hopper 17.

Figures 7A, 7B, 7C:
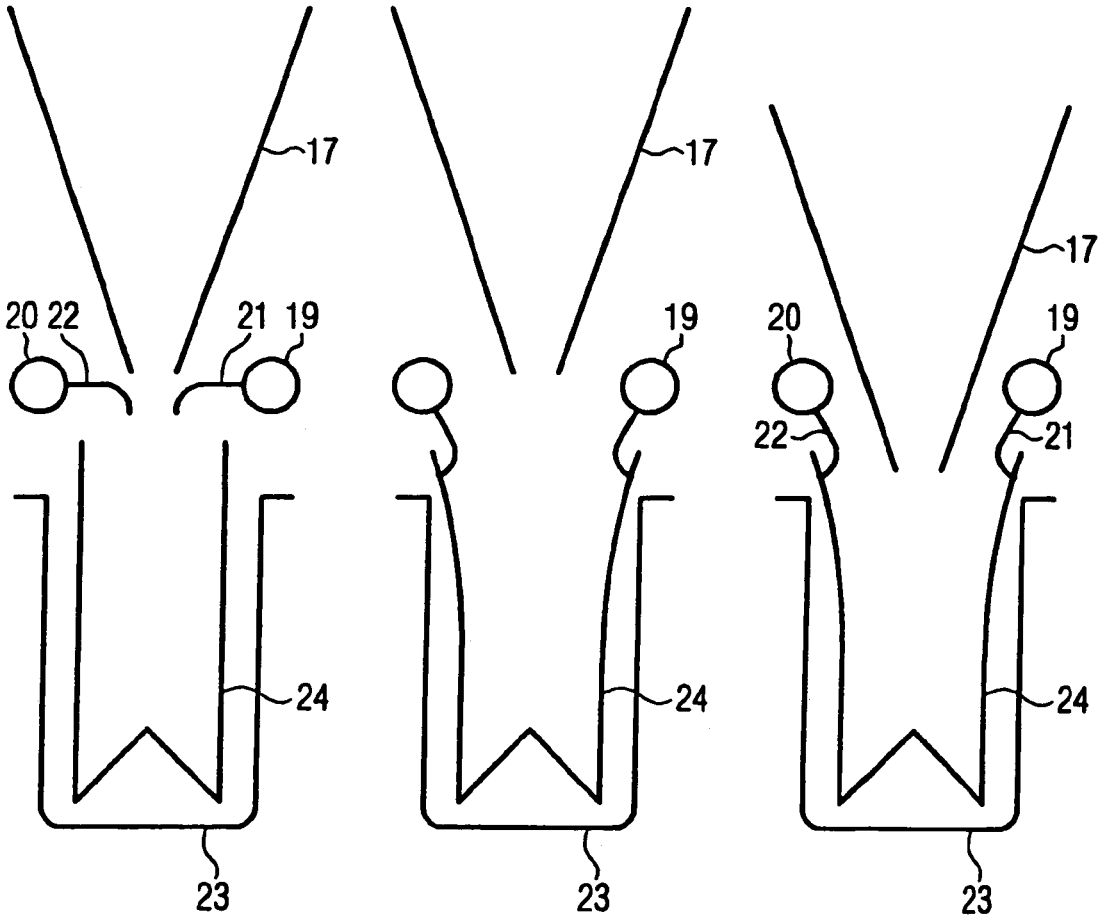
FIG. 7 shows a device to fill foil bags.

FIG. 7 shows the lowering of the filling hopper 17 during filling in detail. In FIG. 7*a*, a receptacle 23 with a foil bag 24 has arrived underneath a filling hopper 17. Arms 21, 22 from the swiveling rods 19, 20 are in an upper position so that the bag transport is not impeded. By swiveling the rods 19, 20, the arms 21, 22 can be moved into a lower position, whereby the upper side foils of the foil bag 24 are pulled apart. This creates the space required for the filling hopper 17. This situation is shown in FIG. 7*b*. After opening of the foil bag 24, the filling hopper 17 can be lowered. Here, the lower opening of the filling hopper 17 ends inside the foil bag 24. In the condition shown in FIG. 7*b* or 7*c*, solid food can now be reliably filled into the foil bag 24. After the filling hopper 17 has been lowered into the condition shown in FIG. 7*c*, it is advantageous to take the filling hopper 17 once again into the position of FIG. 7*b* and then lower it again into the position in FIG. 7*c*. The effect of this is that any food that was stuck in the filling hopper 17 is loosened and passed into the foil bag 24 when the filling hopper 17 is lowered for the second time. After the foil bag 24 has been filled, the filling hopper 17 is returned to the condition in FIG. 7*a*, i.e. conveyed upwards until it is above the foil bag 24 and the rods 19, 20 are swiveled so that the arms 21 and 22 are in the upper position once again (see FIG. 7*a*). The receptacle 23 can then be moved away to the side, which means that the foil bag 24 is also moved away to the side.

The rods 19, 20 with the arms 21, 22 can also be used for opening for filling with liquid products.

The device can have several filling lines positioned next to each other, whereby, for example, neighboring receptacles 23 are connected with each other so that they can be moved together. In this way, for example, at least 10, at least 15 or even more filling lines can be provided next to each other, whereby every filling line comprises its own filling hopper 17 and its own dosing device. The filling lines can have a common storage hopper 2 and a common linear stirring unit 3.

We claim:

1. A system for filling foil bags with food, the system comprising:

a transporting device for transporting a plurality of foil bags;

a dosing device having a plurality of dosing chambers for providing a predetermined quantity of solid foods, said plurality of dosing chambers being positioned adjacent to one another;

a plurality of slides, each of said slides corresponding to one of said plurality of dosing chambers;

a drive constructed and arranged to selectively control movement of the plurality of slides;

a filling device for filling the foil bags with the predetermined quantity of solid foods; and a closing device for closing the foil bags;

wherein the dosing chambers are formed proximate the slides, wherein each slide is constructed and arranged to be selectively separable from the drive in response to a control command, such that the drive does not control the movement of the slide when the slide is separated from the drive, while the drive controls the movement of remaining slides; and wherein each dosing chamber has an adjustable volume.

2. The system according to claim 1, wherein the dosing device is constructed and arranged to provide a variety of predetermined quantities of food.

3. The system according to claim 1, wherein the dosing chamber is movable between a loading position and an unloading position.

4. The system according to claim 3, wherein the dosing chamber is located under a storage hopper when the dosing chamber is in the loading position.

5. The system according to claim 3 wherein the dosing chamber is located above a foil bag when the dosing chamber is in the unloading position.

6. The system according to claim 1, wherein the dosing chamber comprises a first aperture at the top when the dosing chamber is in the loading position and a second aperture at the bottom when the dosing chamber is in the unloading position.

7. The system according to claim 1, wherein the dosing chamber is constructed and arranged to be displaced at an adjustable height.

8. The system according to claim 7, wherein the height is telescopically adjustable.

9. The system according to claim 1, wherein the drive comprises an adjustable pawl for selectively permitting the drive to control the movement of the slide.

10. The system according to claim 9, wherein one drive can control the movement of a plurality of slides, each slide being selectively coupled to the drive by a pawl.

11. The system according to claim 1, wherein the filling device comprises a storage hopper comprising a distribution unit.

12. The system according to claim 11, wherein the distribution unit comprises a linear stirring unit comprising rods which can be moved back and forth.

13. The system according to claim 1, wherein the filling device comprises a product line which ends at the foil bags.

14. The system according to claim 13, wherein the product line comprises a hopper.

15. The system according to claim 13, wherein the product line is movable so that the end of the product line can be moved in and out of the foil bags.

16. The system according to claim 13, wherein the product line comprises a wedge-shaped end facing the foil bag.

17. The system according to claim 13, comprising a fluid outlet for providing a fluid into the product line.

18. The system according to claim 17, wherein the fluid outlet is in the shape of a ring and/or can distribute the fluid in a ring shape.

19. The system according to claim 1, wherein a plurality of foil bags can be filled in close proximity.

20. The system according to claim 1, wherein the transport device has at least one fixed receptacle for receiving a foil bag.

21. The system according to claim 20, wherein a plurality of foil bags of a suitable size can be arranged in the receptacle in such a way that the receptacle exerts pressure on the foil bags; wherein the foil bags are maintained in an opened position.

22. The system according to claim 20, comprising pressure arms constructed and arranged to exert lateral pressure on the foil bags, suitable for opening and/or maintaining the foil bags at least partially opened, whereby the pressure arms are suitable for supporting the foil bag as the foil bags are shaped.

23. The system according to claim 20, comprising pulling arms constructed and arrange to open a filling opening of the foil bags.

24. The system according to claim 1, wherein the dosing chamber comprises an adjustable volume.

25. The system according to claim 1, wherein the dosing chamber is located in, at, on top of, below or proximate the slide.

26. A method of filling foil bags with a predetermined quantity of solid foods, the method comprising:

providing a plurality of dosing chambers having an adjustable volume to receive a variety of quantities of solid foods;

providing a plurality of slides each of said slides corresponding to one of said plurality of dosing chambers, the plurality of slides being selectively displaceable between a first position and a second position;

positioning the plurality of dosing chambers adjacent to each other, each dosing chamber having a loading position when the corresponding slide is in the first position and an unloading position when the corresponding slide is in the second position;

selectively adjusting one of the plurality of dosing chambers to receive a predetermined quantity of solid foods;

selectively filling the plurality of dosing chambers with solid foods when the dosing chambers are in the loading position;

selectively removing the solid foods from the plurality of dosing chambers when the dosing chambers are in the unloading position;

transporting a plurality of foil bags to a filling position proximate the plurality of dosing chambers;

filling the foil bags with the predetermined quantity of solid foods at the filling position;

confirming that a foil bag is present in the filling position prior to selectively removing the solid foods from the dosing chamber;

selectively disassociating one of the slides corresponding to one of the dosing chambers if a foil bag is not present in the filling position proximate said dosing chamber, such that the solid foods are not removed from said dosing chamber if a foil bag is not present in the filling position while the solid foods are removed from the remaining dosing chambers corresponding to the remaining slides; and closing the foil bags.

27. The method according to claim 26, comprising filling a first foil bag with a first predetermined quantity of food, changing the size of the dosing chamber and filling a second foil bag with a second, different predetermined quantity of food.

28. The method according to claim 26, comprising determining whether or not a foil bag is located at a filling position for foil bags.

29. The method according to claim 26, comprising filling the foil bags with the solid foods using a product line.

30. The method according to claim 29, comprising moving the product line to and/or from the foil bag.

31. The method according to claim 29, comprising providing a gas into the product line while filling the foil bag.

32. The method according to claim 29, wherein the product line is moistened on a side in contact with the foods.

33. The method according to claim 29 wherein the product line is moistened with steam on a side in contact with the foods.

34. The method according to claim 26, wherein the foil bags are transported in receptacles which are constructed and arranged to exert pressure on one or more sides of the foil bags.

35. The method according to claim 26, comprising exerting pressure on one or more sides of the foil bag in such a way that the foil bag opens up more.

36. The method according to claim 26, comprising opening the filling opening of the foil bags prior to filling.

37. The method according to claim 26, comprising filling a liquid into the foil bags.

38. The method according to claim 26, comprising using a filling hopper for filling the foil bags.

39. A system for filling foil bags with food, the system comprising:

a transporting device for transporting a plurality of foil bags;

a dosing device for providing a predetermined quantity of solid foods, wherein the dosing device includes a plurality of dosing chambers positioned adjacent to each other, each dosing chamber having a selectively adjustable volume;

wherein each dosing chamber is proximate a slide corresponding to each dosing chamber, each slide being selectively movable by a common drive;

wherein each slide is selectively separable from the drive in response to a control command, such that if a first slide is separated from the common drive, the first slide is not movable by the common drive, whereas other slides remain movable by the common drive;

a filling device for filling the foil bags with the predetermined quantity of solid foods; and a closing device for closing the foil bags.

40. The system according to claim 39, wherein the dosing device is constructed and arranged to provide a variety of predetermined quantities of food.

41. The system according to claim 39, wherein the dosing chamber is movable between a loading position and an unloading position.

42. The system according to claim 41, wherein the dosing chamber is located under a storage hopper when the dosing chamber is in the loading position.

43. The system according to claim 41, wherein the dosing chamber is located above a foil bag when the dosing chamber is in the unloading position.

44. The system according to claim 39, wherein the dosing chamber comprises a first aperture at the top when the dosing chamber is in the loading position and a second aperture at the bottom when the dosing chamber is in the unloading position.

45. The system according to claim 39, wherein the dosing chamber has an adjustable height.

46. The system according to claim 45, wherein the height is telescopically adjustable.

47. The system according to claim 39, wherein the drive comprises an adjustable pawl for selectively permitting the drive to control the movement of the slide.

48. The system according to claim 39, wherein the filling device comprises a storage hopper comprising a distribution unit.

49. The system according to claim 48, wherein the distribution unit comprises a linear stirring unit comprising rods which can be moved back and forth.

50. The system according to claim 39, wherein the filling device comprises a product line which ends at the foil bags.

51. The system according to claim 50, wherein the product line comprises a hopper.

52. The system according to claim 50, wherein the product line is movable so that the end of the product line can be moved in and out of the foil bags.

53. The system according to claim 50, wherein the product line comprises a wedge-shaped end facing the foil bag.

54. The system according to claim 50, comprising a fluid outlet for providing a fluid into the product line.

55. The system according to claim 54, wherein the fluid outlet is in the shape of a ring and/or can distribute the fluid in a ring shape.

56. The system according to claim 39, wherein a plurality of foil bags can be filled in close proximity.

57. The system according to claim 39, wherein the transporting device has at least one fixed receptacle for receiving a foil bag.

58. The system according to claim 57, wherein a plurality of foil bags of a suitable size can be arranged in the receptacle in such a way that the receptacle exerts pressure on the foil bags; wherein the foil bags are maintained in an opened position.

59. The system according to claim 57, comprising pressure arms constructed and arranged to exert lateral pressure on the foil bags, suitable for opening and/or maintaining the foil bags at least partially opened, whereby the pressure arms are suitable for supporting the foil bag as the foil bags are shaped.

60. The system according to claim 57, comprising pulling arms constructed and arrange to open a filling opening of the foil bags.

61. The system according to claim 39, wherein the dosing chamber is located in, at, on top of, below or proximate the slide.

62. The system according to claim 39, wherein one drive can control the movement of a plurality of slides, each slide being selectively coupled to the drive by a pawl.

63. A method of filling foil bags with a predetermined quantity of solid foods, the method comprising:

providing a plurality of dosing chambers having an adjustable volume;

providing a plurality of slides, each of said slides corresponding to one of said plurality of dosing chambers;

providing a drive constructed and arranged to selectively displace the plurality of slides;

positioning the plurality of dosing chambers adjacent to one another, each dosing chamber having a loading position when the corresponding slide is in a first position and an unloading position when the corresponding slide is in a second position;

selectively adjusting the volume of the dosing chambers to receive a first predetermined quantity of solid foods;

selectively displacing the slides into the first position via the drive and selectively filling the dosing chambers with the first predetermined quantity of solid foods when the dosing chambers are in the loading position;

selectively displacing the slides into the second position via the drive and selectively removing the first predetermined quantity of solid foods from the dosing chambers when the dosing chambers are in the unloading position;

transporting a plurality of foil bags to a plurality of filling positions, each filling position corresponding to one of the dosing chambers;

determining whether or not a foil bag is present at a first filling position corresponding to a first dosing chamber, the first dosing chamber having a first slide corresponding thereto;

disassociating the first slide from the drive if a foil bag is not present in the first filling position, such that when the drive selective displaces the slides, the first slide is not displaced;

filling at least one of the plurality of foil bags with the first predetermined quantity of solid foods at the filling positions;

adjusting a second dosing chamber to provide a second volume, wherein the second dosing chamber is constructed and arranged to receive a second predetermined quantity of solid foods at the second volume;

selectively filling the second dosing chamber with the second predetermined quantity of solid foods when the second dosing chamber is in the loading position;

selectively removing the second predetermined quantity of solid foods from the second dosing chamber when the second dosing chamber is in the unloading position;

filling a second foil bag with the second predetermined quantity of solid foods at a second filling position corresponding to the second dosing chamber.

64. The method according to claim 63, comprising filling the foil bags with the solid foods using a product line.

65. The method according to claim 64, comprising moving the product line to and/or from the foil bag.

66. The method according to claim 64, comprising providing a gas into the product line while filling the foil bag.

67. The method according to claim 64, wherein the product line is moistened on a side in contact with the solid foods.

68. The method according to claim 64, wherein the product line is moistened with steam on one side in contact with the foods.

69. The method according to claim 63, wherein transporting a plurality of foil bags includes transporting the foil bags in receptacles, the receptacles being constructed and arranged to exert pressure on one or more sides of the foil bags.

70. The method according to claim 63, comprising exerting pressure on one or more sides of the foil bags to open the foil bags.

71. The method according to claim 63, comprising providing a foil bag having a filling opening, and opening the filling opening of the foil bag prior to filling the foil bag with the solid foods.

72. The method according to claim 63, comprising filling a liquid into the foil bags.

73. The method according to claim 63, comprising using a filling hopper for filling the foil bags.

* * * * *